United States Patent [19]

Schaefer

[11] 4,312,542

[45] Jan. 26, 1982

[54] METHOD OF MAKING A BRUSH-BEATER FOR A VACUUM CLEANER

[75] Inventor: Harold W. Schaefer, Bloomington, Ill.

[73] Assignee: National Union Electric Corporation, Greenwich, Conn.

[21] Appl. No.: 110,099

[22] Filed: Jan. 7, 1980

Related U.S. Application Data

[62] Division of Ser. No. 911,978, Jun. 2, 1978, Pat. No. 4,209,873.

[51] Int. Cl.[3] ..... A46B 7/10; A46D 1/08; A46D 3/00

[52] U.S. Cl. ..... 300/21; 29/421 R; 29/450; 72/62; 72/56

[58] Field of Search ..... 29/450, 421 R; 300/21; 15/366, 386, 182, 183; 72/62, 56, 61, 54

[56] References Cited

U.S. PATENT DOCUMENTS

| | | | |
|---|---|---|---|
| 1,866,118 | 7/1932 | Lowry | 15/183 |
| 1,942,497 | 1/1934 | Smellie | 15/182 |
| 1,991,975 | 2/1935 | Carlson | 15/183 |
| 1,993,229 | 3/1935 | Taylor | 15/366 X |
| 2,038,304 | 4/1936 | Middler | 72/56 |
| 2,085,700 | 6/1937 | Kitto | 15/386 X |
| 2,300,267 | 10/1942 | Smellie | 300/21 |
| 2,411,488 | 11/1946 | White | 15/182 |
| 2,479,702 | 8/1949 | Road | 29/421 X |
| 2,707,792 | 5/1955 | Waller | 300/21 X |
| 2,783,095 | 2/1957 | Ballard | 300/21 |
| 2,960,141 | 11/1960 | Rutter | 72/62 |
| 3,218,698 | 11/1965 | Escherich | 29/421 |
| 3,575,025 | 4/1971 | Tokohama-shi et al. | 72/62 |
| 4,052,872 | 10/1977 | Herr | 72/62 |

FOREIGN PATENT DOCUMENTS

| | | | |
|---|---|---|---|
| 411753 | 6/1934 | United Kingdom | 15/183 |

*Primary Examiner*—Charlie T. Moon
*Attorney, Agent, or Firm*—Alfred E. Miller

[57] ABSTRACT

A brush-beater assembly for a vacuum cleaner comprises a hollow cylinder having outwardly extending projections formed in the material thereof, and slots diametrically opposed to the projections for receiving brush assemblies. The projections may be formed pneumatically or hydraulically in the cylinder, during the production thereof. An additional projection is provided in front of the brush assemblies.

7 Claims, 15 Drawing Figures

Fig. 4.
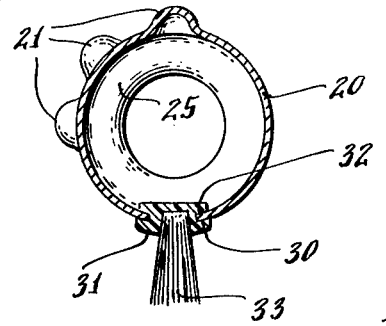
Fig. 5.
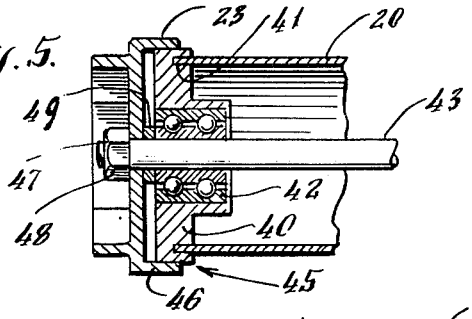
Fig. 6.
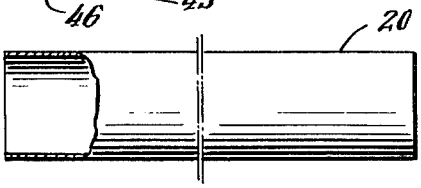
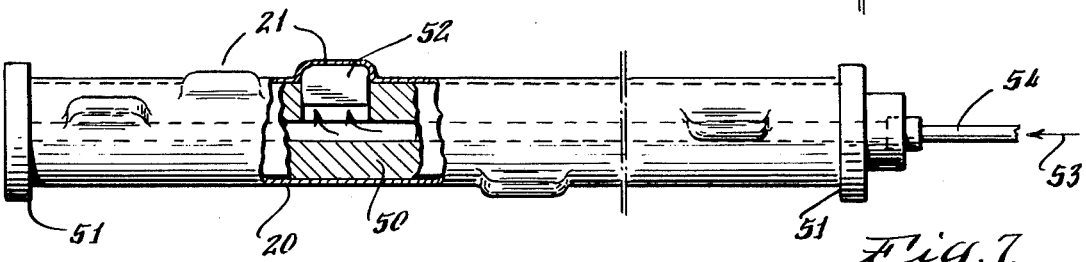
Fig. 7.
Fig. 8.
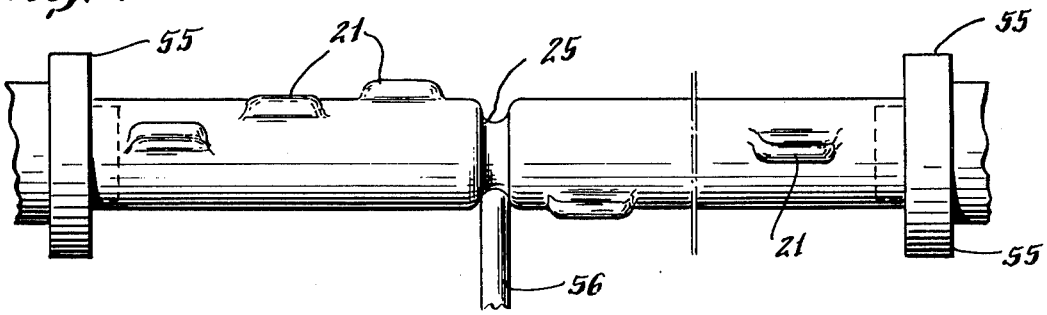
Fig. 9.
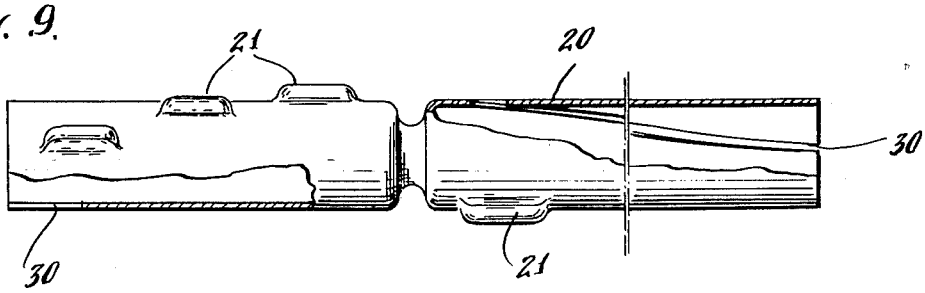

METHOD OF MAKING A BRUSH-BEATER FOR A VACUUM CLEANER

This is a division of application Ser. No. 911,978, filed June 2, 1978, now U.S. Pat. No. 4,209,873, issued July 1, 1980.

BACKGROUND OF THE INVENTION

This invention relates to brush-beater assemblies for vacuum cleaners, and to a method for making this type of assembly.

In vacuum cleaners, it is conventional to provide a rotatable element having a brush extending axially or helically and opposed, on an opposite side of the assembly, by a projection serving as a beater. This type of device is particularly adaptable to the sweeping of carpets, in order to facilitate the removal of dirt from the carpet by agitation of the fibers thereof. For example, in one form of such an assembly, the base of the assembly is formed by a wooden rod provided with a pulley on one end. A longitudinally extending brush is affixed to one side of the rod, and a longitudinally extending beater projection is affixed to the other side of the rod. Of course many other forms of such assemblies have been provided.

In the past, many different other forms of brush-beater assemblies have been provided, each having its own disadvantage. For example, U.S. Pat. No. 3,737,937, Nordeen, discloses an assembly which must be fabricated from a plurality of axially adjacent segments, with the beater bars being inserted into channels extending through these segments. U.S. Pat. No. 3,683,444, Schaefer et al, discloses a metallic beater-brush assembly wherein the roll is formed from a helical metallic member, the brushes and beater bars also being inserted in slots in the roll.

In addition, U.S. Pat. No. 3,909,871, Parker, discloses a brush-beater assembly formed of a helical sheet metal element having edge channels, wherein the beater bars and brushes are also separately inserted in the channels.

In general, while such assemblies may function properly, they are usually difficult or time consuming to fabricate, and they may not have adequate strength for long periods of hard use.

SUMMARY OF THE INVENTION

The present invention is therefore directed to the provision of a readily and economically fabricated brush-beater assembly for a vacuum cleaner, the resultant assembly having great strength for long time, trouble free operation.

Briefly stated, in accordance with the invention, the brush-beater assembly is comprised of a preferably metallic thin wall tube having beater projections in the form of outward deformation of the base material of the tube. These projections may be formed, during an initial stage of production of the assembly, by pneumatic or hydraulic processes.

The tube is further provided with longitudinally or helically extending slots for receiving brush assemblies. As a consequence, the brush assemblies can be prefabricated, and can be readily replaced if necessary upon disassembly of the structure. The brush assemblies may be comprised, for example, of elongated plastic base members, having side grooves for receiving the sides of the slots of the tube, and brushes embedded in the base member and extending radially outwardly therefrom.

The brush-beater assembly is further provided with end disks for holding the tube, with bearings being provided in the disks for rotatably mounting the structure.

In a further modification of the invention, additional projections may be provided on the tube adjacent the brushes. Such additional projections serve as further beater bars, and also aid in the protection of the base of the element from which the bristles themselves extend.

BRIEF FIGURE DESCRIPTION

In order that the invention will be more clearly understood, it will now be disclosed in greater detail with reference to the accompanying drawings, wherein:

FIG. 4 is a transverse cross-sectional view of the brush-beater assembly of FIGS. 1–3, taken along the lines 4—4 of FIG. 3;

FIG. 5 is an enlarged partially cross-sectional view of the rotary end mounting for the brush-beater assembly of FIGS. 1–3;

FIGS. 6–9 show four successive forming steps for the brush-beater assembly of FIGS. 1–3, in accordance with a preferred embodiment of the invention;

DETAIL OF DISCLOSURE

Figure 1:
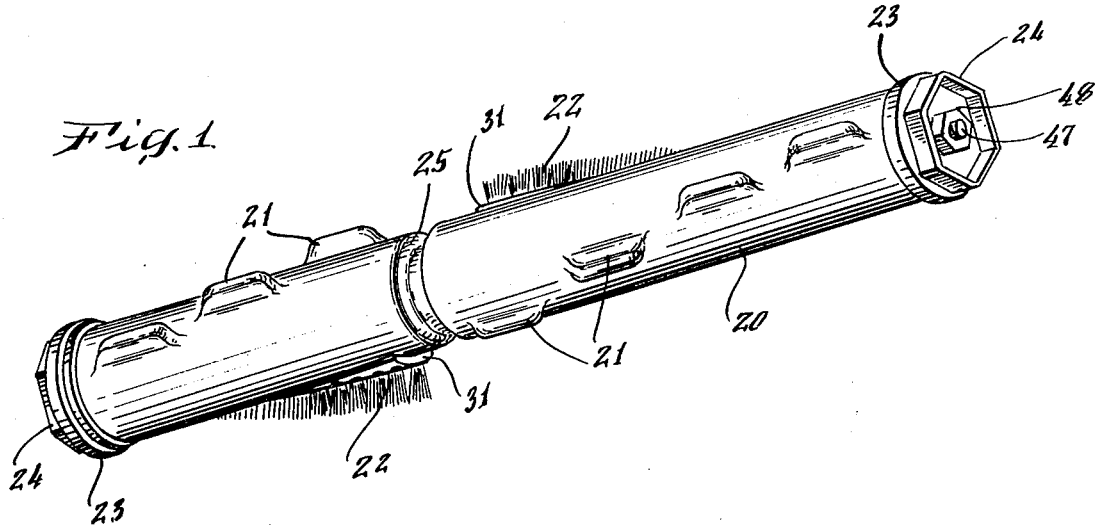
FIG. 1 is a perspective view of a brush-beater assembly for a vacuum cleaner, in accordance with one embodiment of the invention.
Figure 2:
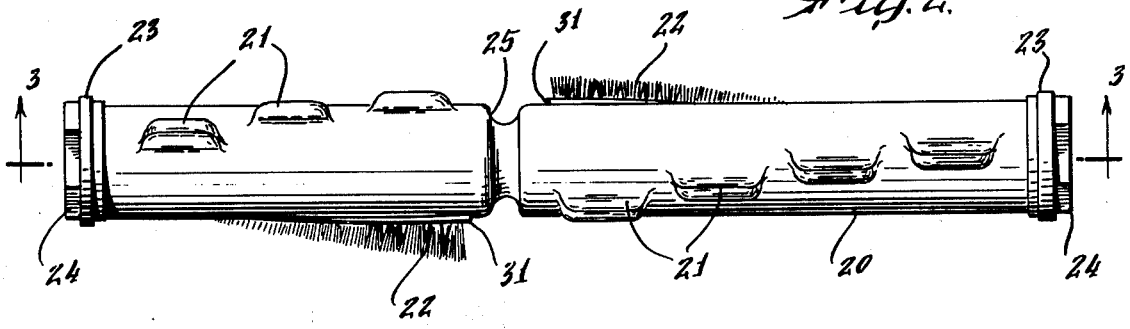
FIG. 2 is a side view of the brush-beater assembly of FIG. 1.
Figure 3:
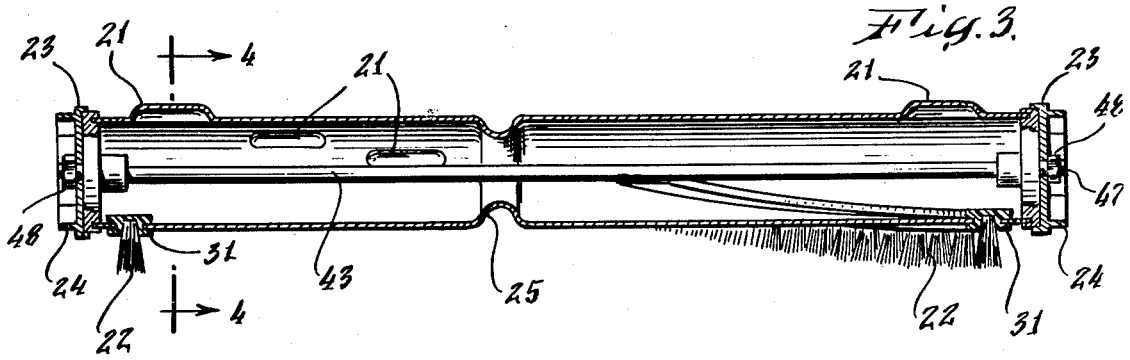
FIG. 3 is a cross-sectional view of the brush-beater assembly of FIG. 2, taken along the lines 3—3.

Referring now to the drawings, and more in particular to FIGS. 1–3, therein is illustrated a brush-beater assembly for a vacuum cleaner, in accordance with a preferred embodiment of the invention. The assembly includes a cylindrical rotary element 20 having a plurality of radially outwardly extending projections 21 which form beaters. In addition, one or more brush assemblies 22 are provided on the circumferential surface of the cylinder 20. The function and operation of beaters and brush assemblies for the rotary element of vacuum cleaners are well known, and hence will not be discussed in greater detail here.

The assembly of FIGS. 1–3 further includes a holding element 23 at each end of the cylinder 20. The holders 23 are adapted to be held in substantially fixed position in a vacuum machine, so that the cylinder 20 rotates with respect to the holders 23. In the illustrated embodiment of the invention, the holders 23 may be in the form of castings or mouldings having a configuration, such as the hexagonal projection 24, adapted to inhibit rotation of these elements in a vacuum machine. Thus, sides of the hexagonal configurations 24 may be adapted to engage parallel surfaces in the machine, so that the assembly may be readily slid into position in the machine. It will be course be apparent that the invention is not limited to this configuration, and that other mounting techniques may be employed for mounting and rotary cylinder element 20 in the vacuum cleaning machine.

In addition, the cylinder 20 may be provided with a central annular recess 25, preferably spaced from the longitudinal center of the cylinder 20. The annular recess 25 is adapted to engage a drive belt (not shown) in the vacuum cleaner, in order to enable rotation of the cylinder 20. While this driving technique constitutes the preferred driving technique for an assembly in accordance with the invention, it will be apparent that other techniques, such as the provision of a driving pulley mounted at the end or spaced from the end of the cylinder 20 may alternately be employed. This latter technique for driving a brush-beater assembly is of course also well known.

As illustrated most clearly in FIGS. 1 and 2, the brush assemblies preferably extend generally spirally along the circumference of the cylinder 20, with the brushes at the two ends of the assembly being circumferentially displaced by about 180° on opposite sides of the annular recess 25. In addition, as is conventionally the practice, the beater projections are circumferentially spaced from the brushes, and the respective portions of the cylinder 20, to be generally 180° from the brushes. In the arrangement in accordance with the invention, the beater projections 21 do not themselves extend helically, each projection 21 extending generally longitudinally of the brush-beater assembly. The groups of beater projections 21 are arranged, however, to extend helically, diametrically opposite the brushes. This configuration, as will be apparent from the following disclosure, simplifies the production of the assembly. Thus, in one embodiment of the invention, as illustrated in FIGS. 1 and 2, the cylinder 20 has three projections 21 on one side of the annular recess 25, and four projections 21 of the opposite longitudinal side of the recess 25. Each of the projections 21 have substantially the same length, the projections 21 being arranged to form spiral groups generally diametrically opposed to the brushes in the corresponding region of the assembly.

The structural details of the brush-beater assembly are more clearly illustrated in FIGS. 3–5, wherein, in the preferred embodiment of the invention, the cylinder 20 is comprised of an elongated thin wall hollow metallic tube, with the beater projections 21 comprising radially outwardly extending deformations of the wall of the cylinder. Thus, as is shown in FIGS. 3 and 4, the thickness of the cylinder 20 is substantially uniform throughout its extent, including in the regions thereof deformed for forming the projections (not considering any variations in thickness that may inherently arise in the production process). As is more clearly apparent in FIG. 4, the tube 20 is provided with a helically extending slot 30, the slot extending from each end of the tube, but not extending across the region of the annular recess. The slot 30 is provided for the purpose of mounting the brush in the cylinder, and for this purpose a helical brush holder 31, preferably of plastic material is provided with longitudinally extending side recesses or grooves 32, so that the brush holders 31 may be mounted to the cylinder by sliding them onto the cylinder from each end thereof, with the grooves 32 engaging the edges of the respective slots 30 of the cylinder. The holders 31 are preferably of a plastic material, with radially outwardly extending brushes 33 for the vacuum cleaner embedded or moulded in the plastic base material of the holders 31. The techniques for so embedding brushes in plastic material are well known, and hence need not be further discussed here. The brush holders may be either preformed to have helical shape, or the helical shape may result by the bending of straight holders as they are inserted in the slots 30.

A preferred rotary mounting for the brush-beater assembly of the invention is shown in the enlarged cross-sectional view of FIG. 5, wherein an end disk 40 is provided with an annular recess 41 in its side surface, into which the end of the cylinder 20 extends. The end disk 40 is provided with a central bearing 42, such as a ball bearing, and a shaft 43 extends coaxially through the assembly, whereby the bearing 42 and support disk 40 coaxially support the cylinder 20. Although the disk 40 is adapted to rotate with the cylinder 20, it is not necessary to provide other than a close fit for the cylinder 20 in the groove 41 for this purpose. In a sleeve bearing construction, there would be no axial pressure other than that which occurs when the rotating member moves back and forth axially on the shaft and comes into contact with the bearing ends as a result. In a ball bearing arrangement such as shown in FIG. 5, however, there may be some axial pressure against the ends of the tube.

As more clearly shown in FIG. 5, the radially outer periphery 45 of the disk 40 is round, defining a cylindrical surface, and the support 23 has an annular flange 46 extending axially to surround at least a part of the surface 45, to thereby inhibit the passage of dust or dirt to the bearing. After emerging from the bearing 42, the shaft extends through a central boring in the support member 23, the end 47 of the shaft being threaded. A nut 48 is provided on the threaded end of the shaft. Suitable separation washers 49 may be provided between the adjacent surfaces of the support element 23 and the support disk 40 or its bearing. The distance between the washers at the end of the assembly, if sleeve bearings are employed, is fixed in view of the provision of shoulders on the shaft. In a ball bearing construction as illustrated, however, there may be some axial pressure on the ends of the tube.

The other end of the assembly may be fabricated in the same or a similar manner. It is thereby apparent that the shaft 43 extends through the structure, and serves to relatively rigidly hold the disks 40 on the ends of the cylinder 20, while preventing unintentional separation of the support 23 from the assembly.

The support 23 and disk 40 may be of a cast metal, such as cast aluminum or zinc casting metal, and the cylinder tube 20 is preferably of a metal, such as steel.

In order to fabricate the brush-beater assembly of the invention, in accordance with a further preferred embodiment of the invention, a straight metal tubing of suitable material, such as steel, as shown in FIG. 6, is initially provided. It will of course be apparent that other materials may be employed for the tube, such as an elastomer or any other readily displaceable material. This tubing, of the correct length, is mounted on a pneumatic or hydraulic forming machine, as illustrated in FIG. 7, in order to enable forming the beater projections. Thus, as shown in FIG. 7, the tubing or cylinder 20 is slipped over a hollow mandrel 50 having sealed ends 51. The mandrel is further provided with radially extending ducts 52 at the positions corresponding to the projections to be formed, and a pneumatic or hydraulic forming fluid is introduced into the center of the mandrel, as is illustrated by the arrow 53, for example by way of a pressure tubing 54 extending through one of the end caps 51. The pressure thereby exerted on the relatively thin cylinder wall causes the material of the cylinder wall to deform, and thereby form the projections. If desired, suitable forming means (not shown) may be provided outwardly of the cylinder, to limit and/or shape the projections in a manner similar to a die, in order to insure that the projections have the desired equal heights and substantially the same shapes. In the formation of the bumps, it is of course apparent that it may be necessary to provide suitable holes or the like in the forming means to permit the escape of entrapped air during the formation of the projections.

Alternatively, the projections may be hydraulically or pneumatically formed by other techniques than that illustrated in FIG. 7, for example, by the use of internal pressure cooperating with an external split die, without the use of the internal mandrel as illustrated in FIG. 7. The forming operation for the projections may be at a low temperature, i.e., at a temperature below that at which plastic deformation of the metal of the cylinder may occur.

It is of course apparent that the tubing for the cylinder 20 may alternatively be of a plastic material. In this case, the tubing may constitute an incompletely set material, so that the projections may be formed prior to the final curing steps, or, alternatively, completely set plastic may be employed.

Following the forming of the projections 21, the annular recess 25 may then be formed in the cylinder, as illustrated in FIG. 8. For this purpose, the cylinder 20, with the projections 21 formed therein, may be mounted in a rotary clamp 55, with a suitably shaped tool 56 urged against the side walls of the cylinder to effect the formation of the recess. The sequence of the above operations may be varied, and thus, on some occasions it may be desirable to form the annular recess prior to forming the projections.

Following the formation of the projections 21 and the recess 25, the slots 30 may be formed in the tubing, as illustrated in FIG. 9. These slots may be cut or stamped out of the cylinder by any conventional process, to complete the formation of the basic cylinder 20. Subsequently, the brush assembly is inserted in these slots, and the cylinder may be mounted and combined with the remainder of the components to form the finished assembly.

The brush-beater assembly of the present invention, as disclosed above, may thereby be readily and economically formed, is pleasing in appearance, and also has the necessary strength for heavy duty use in a vacuum cleaner. The assembly further has a minimum of components, so that its assembly time is minimized. Further, since a pulley is not required, the overall useful length of the brush-beater assembly is increased.

The invention provides a further advantage that the separate beater projections provide a more effective beating of carpets or the like which are to be cleaned by the vacuum cleaner. In accordance with the invention, it is apparent that these projections may be readily formed to any desired shape, so that the number, length and shape of the beater projections may be selected without substantially varying the production cost for the structure.

In the above described arrangement in accordance with the invention, the projections 22 were disclosed as extending straight in the axial direction, it being preferable that adjacent projections 21 be circumferentially displaced with respect to one another, so that the projections which extend at discrete distances from one another generally define a helix. In modifications in accordance with the invention, the individual projections 21 themselves may extend helically, so that their external configurations as a whole define a helix, with the ends of each projection still returning to the surface of the outer circumference of the cylindrical tube.

In use, it has been found that, as compared with conventional constructions employing uninterrupted beater bars, the use of separate discrete projections provides the unexpected advantage that the assembly has a reduced tendency toward fouling from hair, thread or the like. Thus, in a conventional construction, wherein the beater bars extend continuously, i.e., without substantial indentation between support and drive regions, or between two support regions, hair, thread or the like has a tendency to feed down the length of the beater bar and into the end cap, where it may freeze the brush roll. As a result, binding and overheating can occur as a result of fouling of the bearings. In the arrangement in accordance with the invention, however, it has been found that such hair and thread tends to be trapped between the beater bars instead of being fed down to the end caps. As a consequence, the brush-beater assembly in accordance with the invention requires less maintenance, and provides superior performance.

In addition, in a typical brush-beater in accordance with the invention, seven individual beater bars may be provided, which have a tendency to agitate the carpet fibers to a much greater extent, thereby opening up the carpet fibers to permit maximum cleaning performance. In arrangements wherein the beater bars are continuous, the beater bars act in a wiping action which tends to lay the carpet fibers flat.

In conventional constructions, as above discussed, there are generally two beater bars, i.e., one on each side of the recess 25. The beater bars thus are relatively long in comparison with the overall length of the assembly. In accordance with the invention, however, the individual projections 21 are relatively short in comparison with the overall length of the assembly. The length requirements of the projections, in accordance with the invention, may be distinguished from the generally continuous beaters of known construction, by a number of criteria. Thus, in accordance with the invention, the projections should have lengths extending in the axial direction of the tube that are no greater than about 1/5 of the length of the tube, or, in other terms, the projections should not have lengths exceeding the diameters of the tube, when considering conventional domestic vacuum cleaning equipment. Expressed differently, however, it may stated that the projections 22 should have lengths not less than about ½ inch and not exceeding about 2 inches, with the ends of the projections preferably extending fully to the base portion of the rotary element, i.e., to the tube 20 in the disclosed embodiment of the invention. In some embodiments of the invention, the use of projections may be made in combination with a bar that does not have a circular cross-section, such as for example disclosed in U.S. Pat. No. 3,683,444, Schaefer et al. In this instance, for purposes of definition, for purposes of the invention the axial ends of the projections should be from about ⅛ inch to ½ inch above the surface of the bars from which the projections extend.

In a preferred embodiment of the invention, the tube had a length of about 11.2 inches, and a diameter of about 1.4 inches. The projections 21 had heights of about 0.080 inches, transverse radii of curvature of about 0.156 inches, and lengths at the intersection thereof with the tube of about 0.75 inches. The spacing between the centers of the projections, in the axial direction, was about 1.4 inches, with the adjacent projections being angularly displaced with respect to one another by about 22.5°. The slot for receiving the brush assembly had a width of about 0.37 inches. The tube itself was formed of cold rolled steel tubing.

Figure 10:
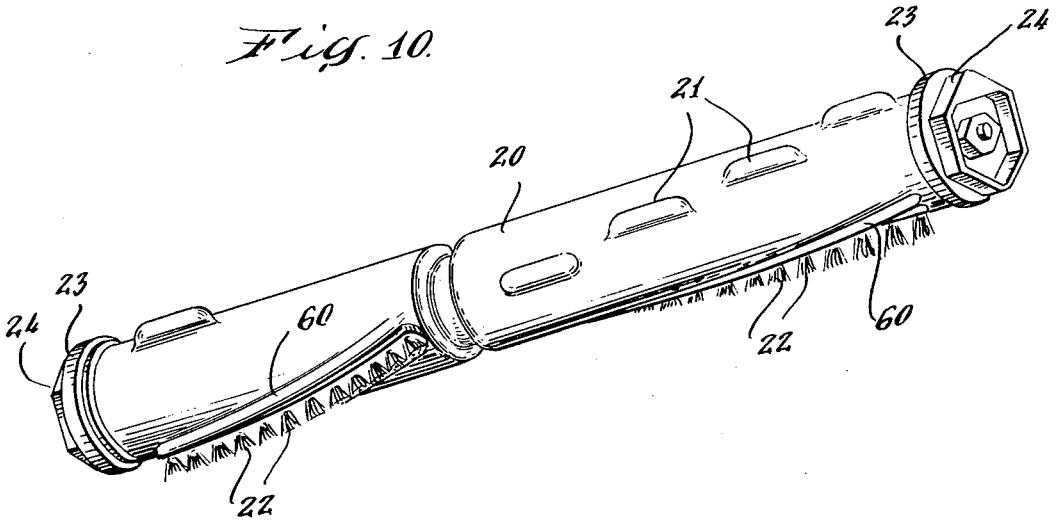
FIG. 10 is a perspective view of a brush-beater assembly in accordance with a further embodiment of the invention.
Figure 11:
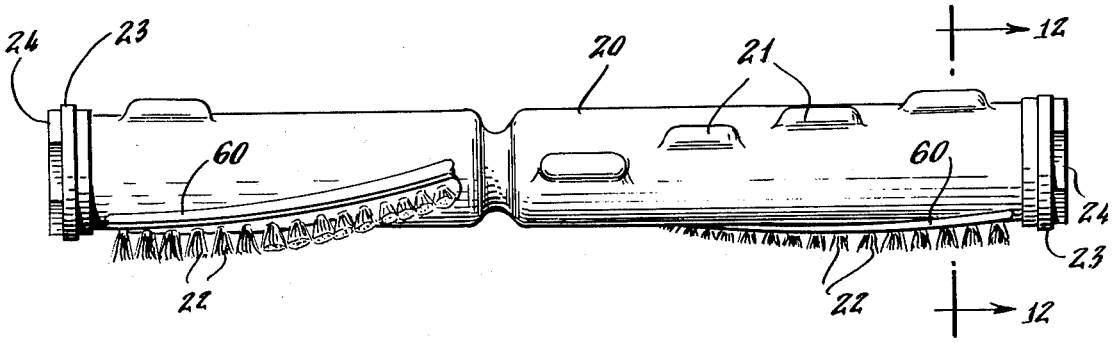
FIG. 11 is a side view of the brush-beater assembly of FIG. 10.
Figure 12:
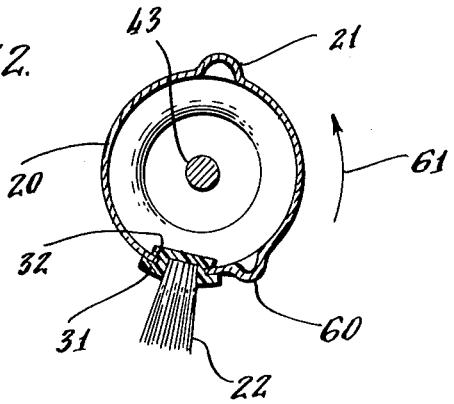
FIG. 12 is a cross-sectional view, taken in a transverse plane, of the brush-beater assembly of FIG. 11, along the lines 12—12.

In accordance with a further feature of the invention, as illustrated in FIGS. 10–12, an additional beater bar structure 60 may be provided on the tube 20 immediately in front of the brush 22. In other words, as shown in FIG. 12, when the tube 20 rotates counter-clockwise, in the direction of the arrow 61, the projection 60 leads the brush 22, i.e., is immediately counterclockwise of the brush 22. As an example, the projection 60 may be spaced in the order of about 0.1 inches on the circumference of the tube from the slot into which the brush assembly is inserted.

This additional beater 60 is preferably continuous, i.e., its axial length is in conformity with the lengths of conventional bars or projections, as opposed to the much shorter bars as above described which are diametrically opposed to the brushes. The projections 60 preferably have heights of 0.125 inches. While the projections 60 are preferably continuous, it will of course be apparent that in further modifications of the invention these projections may have shorter lengths so as to conform to the above described projections 21.

The additional beater bars 60 serve to protect the base or holder of the brushes, from abrasive action in use, and the additional beaters also provide further beating action of carpets or the like in vacuum cleaning operations.

The additional or auxiliary beater bar or projection 60 may be formed in the tube 20 by the same technique as that employed in the formation of the discrete beater bars 21, as above discussed.

Figure 13:
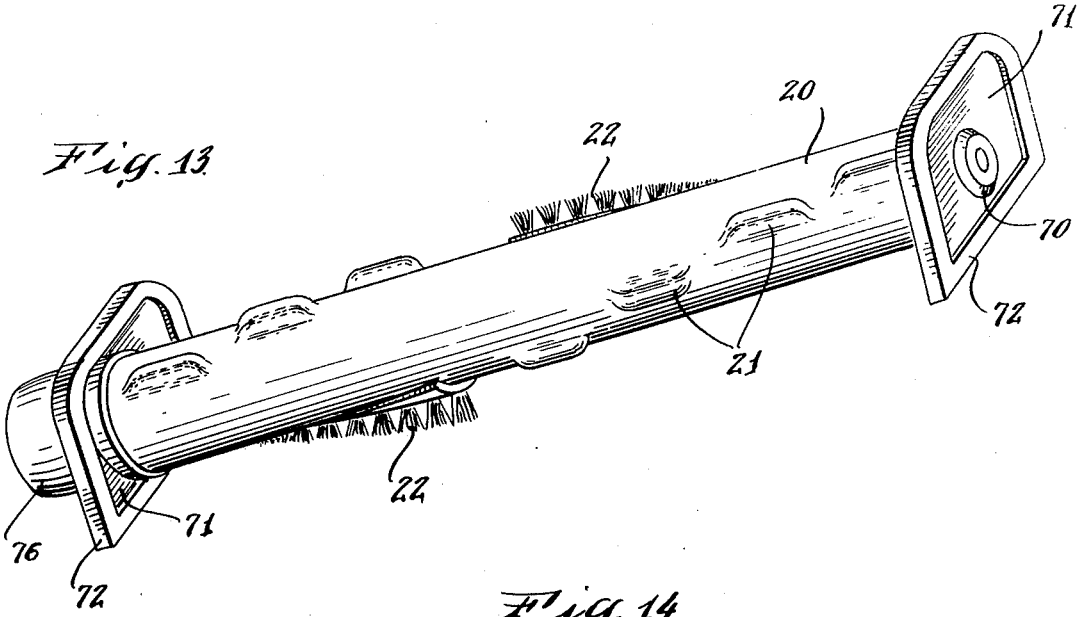
FIG. 13 is a perspective view of a still further modification of the invention.
Figure 14:
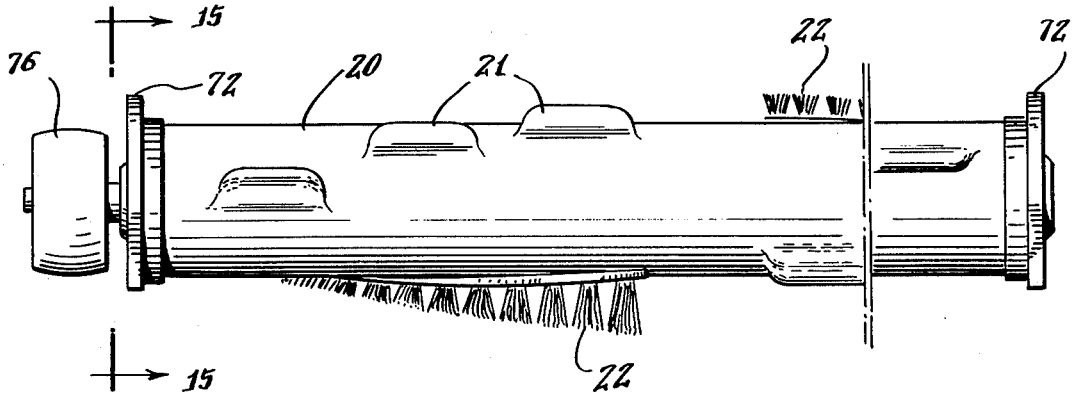
FIG. 14 is a side view of the brush-beater assembly of FIG. 13.
Figure 15:
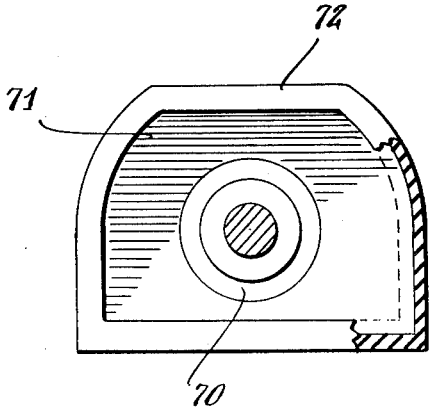
FIG. 15 is an enlarged partially cross-sectional view of the brush-beater assembly of FIG. 14 taken along the lines 15—15.

In a further embodiment of the invention, as illustrated in FIGS. 13–15, the tube 20 may be of the form which is not provided with a central annular recess for driving purposes. In this modified form of the structure, the drive is effected by means of a separate pulley 76 on the end of the central shaft, which in this case extends beyond the tube 20. The arrangement of FIGS. 13–15 is of the type wherein the bearings 70 for the shaft are supported in end plates 71, of generally rectilinear shape with rounded corners, the plates 71 being provided with resilient edge coverings 72 for insertion in suitable slots in the vacuum cleaning device. This latter form of mounting is of course known.

In the arrangement of FIGS. 13–15, the projections 21 are provided in the same manner as in the previously disclosed embodiments of the invention, the primary difference being the absence of the annular drive recess in the tube 20.

While the features of the invention, as above disclosed, are particularly useful when the projections are formed in a cylindrical tube, it will be apparent that the discrete projections may also be provided in other beater bar assemblies in accordance with the invention, either those having the beater bars formed from the material of the base structure itself, or formed as inserts in the manner, for example, of U.S. Pat. No. 3,683,444, Schaefer et al. In this latter case, for example, the insertable beater bars may be formed with indentations, for example prior to insertion thereof into the base, in accordance with the invention. In this case, of course, the indentations will result in effective projections with dimensions as defined above.

While the invention has been disclosed and described with reference to a limited number of embodiments, it will be apparent that variations and modifications may be made therein, and it is therefore intended in the following claims to cover each such variation and modification as falls within the true spirit and scope of the invention.

What is claimed is:

1. A method for forming a rotatable brush-beater assembly for a vacuum cleaner, comprising the steps of outwardly deforming a thin wall tube by applying fluid pressure inside of said tube without outside support, to form radially outwardly projecting axially spaced short beater projections extending in a line, and then affixing a brush assembly to said tube at a location circumferentially displaced from said projections.

2. The method of claim 1 wherein said step of affixing comprises providing a helically extending slot in said tube, and sliding a brush assembly in said slot to engage the sides of said slot.

3. The method of claim 1 further comprising forming a pulley in said tube by rotating said tube and simultaneously radially inwardly deforming said tube at a generally central location thereof, to form an annular recess.

4. A method for forming a rotatable brush-beater assembly for a vacuum cleaner, comprising the steps of providing a thin wall tube of deformable material, placing said tube on a hollow mandrel having radially extending ducts, applying fluid pressure to the hollow interior of said mandrel without outside support of said tube, whereby the pressure thereby exerted on said tube forms axially space short projections extending in a line thereon, and then providing axially extending slits in said tube and urging brush assemblies axially into said slits.

5. The method of claim 4 further comprising forming an annular recess in said tube between the ends thereof by urging a forming tool radially against said tube.

6. The method of claim 4 wherein said step of forming slits comprises forming said slits immediately circumferentially adjacent projections formed by deformation resulting from said fluid pressure.

7. The method of claim 6 wherein said step of forming slits comprises forming slits that extend helically in the axial direction of said tube.

* * * * *